US007009095B2

(12) United States Patent
Ichikawa et al.

(10) Patent No.: US 7,009,095 B2
(45) Date of Patent: Mar. 7, 2006

(54) KEYBOARD MUSICAL INSTRUMENT WITH LATERALLY ADJUSTABLE BUILT-IN MUSIC RACK AND MUSIC RACK USED THEREIN

(75) Inventors: Tomonori Ichikawa, Shizuoka-ken (JP); Satoshi Inoue, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 94 days.

(21) Appl. No.: 10/753,221

(22) Filed: Jan. 7, 2004

(65) Prior Publication Data

US 2004/0187667 A1 Sep. 30, 2004

(30) Foreign Application Priority Data

Mar. 27, 2003 (JP) ..... 2003-087404

(51) Int. Cl.
*G10C 3/02* (2006.01)

(52) U.S. Cl. ..... 84/177

(58) Field of Classification Search ..... 84/177, 84/178, 179, 180, 181, 182, 184; 248/443
See application file for complete search history.

(56) References Cited

U.S. PATENT DOCUMENTS 2,626,345 A * 1/1953 Caldwell et al. ..... 362/86
4,593,597 A * 6/1986 Albrecht et al. ..... 84/487

FOREIGN PATENT DOCUMENTS

JP 02001175246 A * 6/2001 ..... 84/487
JP 02001242868 A * 9/2001 ..... 84/487

* cited by examiner

*Primary Examiner*—Kimberly Lockett
(74) *Attorney, Agent, or Firm*—Harness, Dickey & Pierce, PLC

(57) ABSTRACT

A grand piano has a built-in music rack for keeping a music score book thereon, and the built-in music rack includes a guide laterally extending inside the piano cabinet and a desk board projecting over the piano cabinet and connected to the guide; when a pianist exerts force on the desk board, the guide permits the desk board to slide laterally so that the pianist can easily adjust the music score book to a proper position; since most of the guide is hidden inside the piano cabinet, the pianist feels the grand piano same in external appearance as a standard grand piano.

13 Claims, 4 Drawing Sheets

KEYBOARD MUSICAL INSTRUMENT WITH LATERALLY ADJUSTABLE BUILT-IN MUSIC RACK AND MUSIC RACK USED THEREIN

FIELD OF THE INVENTION

This invention relates to a keyboard musical instrument and, more particularly, to a keyboard musical instrument with a music rack assembly.

DESCRIPTION OF THE RELATED ART

Various sorts of keyboard musical instrument are sold in the market. The acoustic pianos, organs and electronic pianos are the members of the keyboard musical instrument. Music racks are usually provided on the acoustic pianos such as the grand pianos and electronic pianos. The music racks have respective desk boards, and the desk boards are usually foldable. When a pianist prepares the keyboard musical instrument for performance, he or she makes the desk board stand, and puts a music score against the desk board.

In the following description, term "front" is indicative of a position closer to a player sitting on a stool for fingering a music passage on the keyboard musical instrument than a "rear" position. The direction between a front point and a corresponding rear point is referred to as "fore-and-aft" direction, and the "lateral" direction crosses the fore-and-aft direction at right angle.

FIG. 1 illustrates a typical example of the grand piano. Reference numeral 1 designates the grand piano. The grand piano 1 includes a piano cabinet 2, a keyboard 3, a fall board 4 and a top board 5. A key bed 2*a* defines part of the bottom of the piano cabinet 2, and the keyboard 3 is mounted on the key bed 2*a*. White keys 3A and black keys 3B are incorporated in the keyboard 3, and are laid on the well-known pattern. The piano cabinet 2 is supported by legs 2*b* over the floor, and a pedal box 2*c* is hung from the piano cabinet 2. Although the action units, damper units, hammers and strings are housed in the piano cabinet 2, they are not shown in the figure, and description is omitted, because they are well known to skilled persons.

A desk rail 6 laterally extends, and a music rack 7 is provided on the desk rail 6. The music rack 7 includes a desk board 7*a*, a prop 8, tooth 11, which are formed in the desk rail 6, and a anti-slip block 14 (see FIG. 2). The desk board 7 is rotatably connected at the lower end portion thereof to the desk rail 6 by means of a hinge 9. The desk board 7 falls down onto the desk rail 6 as indicated by dots-and-dash line, and gets up from the desk rail 6. The anti-slip block 14 laterally extends on the desk rail 6, and is secured to the desk rail 6. The anti-slip block 14 is forwardly spaced from the hinge 9 so as to keep a music score 13 on the front surface of the desk board 7*a*.

The prop 8 is rotatably connected at one end thereof to the reverse surface of the desk board 7*a* by means of a hinge 10 so as to be swingable about the hinge 10. Nevertheless, a stopper 12 sets a limit to the angular motion of the prop 8. The stopper 12 rearward downward projects from the reverse surface of the desk board 7*a* in the vicinity of the hinge 10, and is inclined to the reverse surface by a predetermined angle. Although the user can freely swing the prop 8 within the predetermined angle, the prop can not exceed the stopper 12. The tooth 11 is overlapped with the movable range of the lower end of the prop 8, and the prop 8 is engageable with the tooth 11.

When a pianist prepares the music rack for the performance, he or she grips the desk board 7*a* at the far end portion, and raises the desk board 7*a*. The gravity causes the prop 8 to be spaced from the reverse surface of the desk board 7*a*. When the desk board 7*a* reaches a proper angular position, the pianist slightly pushes the desk board 7*a*, backward. Then, the prop 8 is engaged with one of the tooth 11, and keeps the desk board 7*a* at the proper angular position. The pianist puts the music score 13 against the desk board 7*a*.

If the pianist feels the music score 13 hard to see, he or she pulls the desk board 7*a* frontward, and makes the prop 8 disengaged from the tooth 11. The pianist readjusts the desk board 8 to the proper angular position, and slightly moves the desk board 7*a* backward. Then, the prop 8 is engaged with another teeth 11, and keeps the desk board 7*a* at the proper angular position.

When the pianist folds the music rack 7, the pianist grips the desk board at the far end portion, and slightly pulls it. Then, the prop 8 is disengaged from the tooth 11. The pianist presses the prop 8 to the reverse surface of the desk board 8, and pushes the desk board 7*a* backward. Then, the hinge 9 allows the desk board 7*a* to rotate, and falls onto the desk rail 6.

The applicants investigated other related arts, and found three documents, i.e., Japanese Utility Model Publication of Examined Application sho 54-42900, which is hereinbelow referred to as "the first prior art document", Japanese Utility Model Application laid-open hei 2-81591, which is referred to as "the second prior art document, and Japanese Patent Application laid-open hei 5-241567, which is referred to as "the third prior art document".

The prior art music rack disclosed in the first prior art document is laterally slidable so that a pianist can adjust the desk board to a proper position just confronted with him or her. Namely, the prior art music rack includes a lateral bar secured to the front board of the upright piano and a desk board connected to the lateral bar by means of a spring catcher. The spring catcher is slidable along the lateral bar together with the desk board so that the pianist adjusts the desk board to the proper position through the sliding motion.

The prior art music rack disclosed in the second prior art document is used for a portable keyboard musical instrument, and is attached to and detached from the portable keyboard musical instrument. The prior art music rack includes a desk board turnable about a cylindrical case, a regulating mechanism housed in the cylindrical case and connected to the desk board and a coupling connecting the cylindrical case to the portable keyboard musical instrument. When a user prepares the portable keyboard musical instrument for his or her performance, the user connects the cylindrical case to the portable keyboard musical instrument by means of the coupling, and pushes and pulls the desk board so as to adjust the desk board to a proper position.

The prior art music rack disclosed in the third prior art document is of the type attached to and detached from a keyboard musical instrument. The prior art music rack includes a panel and a desk board. The panel is as wide as or wider than the keyboard, and is formed with a lateral groove or a lateral rail. The groove or rail extends along the keyboard, and a tongue or a socket downwardly projects from the desk board. When a user prepares a keyboard musical instrument for his or her performance, the panel is attached to the keyboard, and the user tightly inserts the tongue or socket into the groove or rail at a proper position just confronted with him or her. The tongue or rail is pinched by the walls, which define the groove, or the socket so that the desk board is maintained at the proper position. If the player feels the desk board hard to see, he or she pulls out the tongue or socket from the groove or rail, and inserts the tongue or rail into the groove or socket at another proper position better than the previous position.

A problem is encountered in the prior art grand piano 1 with the built-in music rack 7 in that the pianists feel the music score 13 hard to see in a four-handed performance. A trainee also feels the music score 13 hard to see when he or she sits side by side together with the music teacher. The reason why they feel the music score hard to see is that the music rack always keeps the music score at the center of the keyboard.

The prior art music rack disclosed in the first prior art document makes the external appearance of the upright piano unsightly, because the lateral bar is exposed to the outside of the piano cabinet. Although a piece of felt is adhered to the bottom of the desk board, the piano cabinet is liable to be marred with the sliding desk board. Moreover, the front board, which rises over the player's head, is required for the prior art music rack, because the lateral bar is to be secured thereto for guiding the desk board. Such front boards are not incorporated in the grand pianos and electronic keyboards. Thus, the prior art music rack is of narrow application.

The problem encountered in the detachable music rack disclosed in the second prior art document is same as that inherent in the grand piano 1. The music rack per se is detachable from the portable keyboard musical instrument. However, the user can not detach the desk board from the cylindrical case. When the music rack is assembled with the portable keyboard musical instrument, the desk board is automatically positioned at the center of the portable keyboard musical instrument, and the user can not move the desk board from the center position to anther position.

The problem encountered in the music rack disclosed in the third prior art document is that the user repeats the insertion and pull-out until the desk board is located at the proper position. The tongue or rail is pinched so tightly the user can not slide the desk board along the groove or rail. Thus, the adjustment work is less easy for the user.

SUMMARY OF THE INVENTION

It is therefore an important object of the present invention to provide a keyboard musical instrument with a music rack, which easily changes a lateral position of a document through lateral motion without any damage to the external appearance.

It is also an important object of the present invention to provide a music rack, which is used for keyboard musical instrument without a wide front board.

In accordance with one aspect of the present invention, there is provided a keyboard musical instrument for generating tones comprising a cabinet defining an inner space and having a surface, a keyboard having plural keys selectively depressed for designating pitches of the tones to be generated and placed on the surface so as to expose the plural keys to the outside of the cabinet, a tone generating system at least partially housed in the cabinet and connected to the keyboard for generating tones at the pitches, and a music rack including a desk board against which a document is put and a guide hidden inside the cabinet and connected to the desk board so as to permit a user to move the desk board in a direction parallel to the keyboard.

In accordance with another aspect of the present invention, there is provided a keyboard musical instrument for generating tones comprising a cabinet defining an inner space and having a top surface defining an upper end thereof and another surface, a keyboard having plural keys selectively depressed for designating pitches of the tones to be generated and placed on the aforesaid another surface so as to expose the plural keys to the outside of the cabinet, a tone generating system at least partially housed in the cabinet and connected to the keyboard for generating tones at the pitches, and a music rack including a desk board projecting over the top surface for keeping a document thereon and a guide provided in the vicinity of the top surface and connected to the desk board so as to permit a user to move the desk board in a direction parallel to the keyboard.

BRIEF DESCRIPTION OF THE DRAWINGS

The features and advantages of the keyboard musical instrument will be more clearly understood from the following description taken in conjunction with the accompanying drawings, in which.

DESCRIPTION OF THE PREFERRED EMBODIMENTS

First Embodiment

Figure 3:
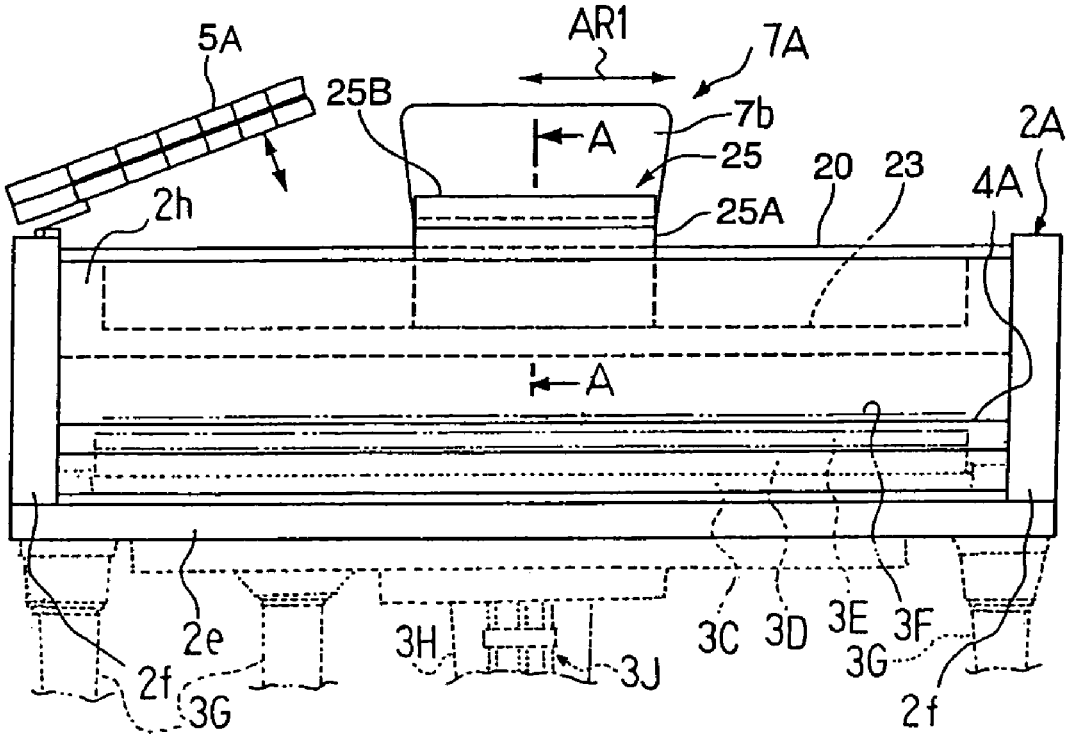
FIG. 3 is a front view showing the appearance of a grand piano with a built-in music rack according to the present invention.
Figure 4:
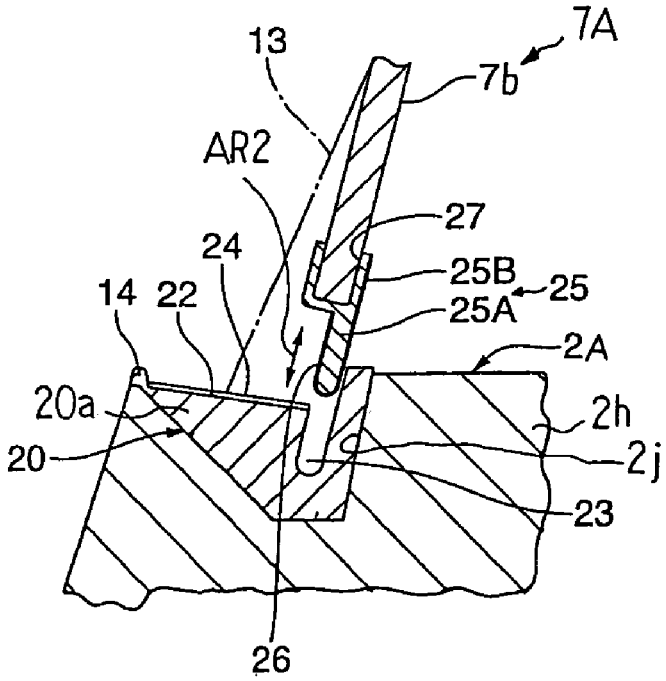
FIG. 4 is a cross sectional view taken along line A—A of FIG. 3 and showing the structure of the built-in music rack.

Referring to FIG. 3 of the drawing, a grand piano embodying the present invention largely comprises a piano cabinet 2A, a keyboard 3C, action units 3D, hammers 3E, strings 3F, dampers (not shown) and a built-in music rack 7A. The piano cabinet 2A defines an inner space, and includes a key bed 2*e*, a side board 2*f* and an upper beam 2*h*. Most of the piano cabinet 2A is made of wood, and metal is partially used in the piano cabinet 2A. The key bed 2*e* forms a part of the bottom of the piano cabinet 2A, and the keyboard 3C is mounted on the front portion of the key bed 2*e*. The side board 2*f* is gently curved like a wing, and forms both sides and the rear of the piano cabinet 2A. The upper beam 2*h* forms an upper portion of the front of the piano cabinet 2A, and laterally extends between both sides of the side board 2*f*. The upper beam 2*h* defines an upper opening together with the side board 2*f*.

Figure 1:
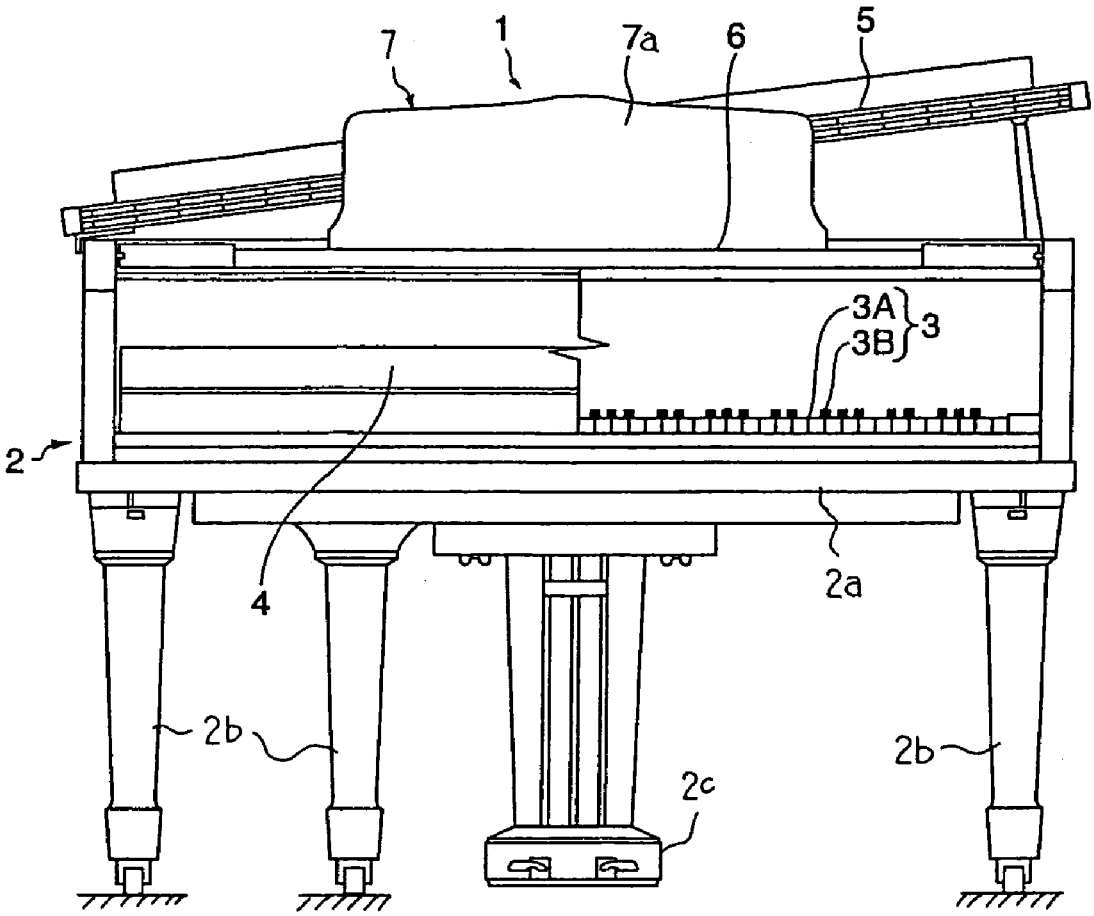
Fig. 1 PRIOR ART
FIG. 1 is a front view showing the appearance of the grand piano equipped with the music rack and partially cut out.
Figure 2:
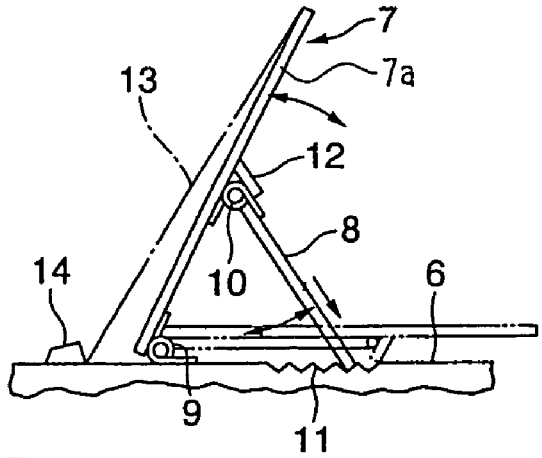
Fig. 2 PRIOR ART
FIG. 2 is a side view showing the structure of the music rack.

A fall board 4A is rotatably supported by the front portion of the side wall 2*f* below the upper beam 2*h* so that the keyboard 3C is covered with the fall board 4A. Of course, when a pianist lifts the front portion of the fall board 4A, the fall board 4A is rotated, and exposes the keyboard 3C to the pianist. Although the white keys 3A and black keys 3B are arrayed on the well-known pattern as similar to those shown in FIG. 1, the fall board 3C shields the white and black keys 3A/3B, and only the outline of the array of white and black keys 3A/3B are indicated by broken lines in FIG. 3. The white and black keys 3A/3B are arranged in the lateral direction. A foldable top board 5A is hinged to the side board 2*f*, and opens and closes the inner space.

Legs 3G are connected to the piano cabinet 2A, and supports the piano cabinet 2A horizontally on a floor. A lyre box (not shown) is hung from the piano cabinet 2A by means of a lyre post 3H, and a foot pedal system 3J is supported by the lyre box and lyre post 3H.

The action units 3D, hammers 3E, strings 3F and dampers (not shown) are housed in the piano cabinet 2A. The action units 3D are linked with the rear portions of the white and black keys 3A/3B, and the pianist selectively actuates the action units 3D by depressing the associated white and black keys 3A/3B. The dampers (not shown) are also actuated by the depressed white and black keys 3A/3B. While the associated white and black keys 3A/3B are staying at rest positions, the dampers are held in contact with the strings 3F, and prevent the strings 3F from unintentional vibrations. The depressed white and black keys 3A/3B make the associated dampers spaced from the strings 3F on the way toward end portions, and permit the strings 3F to vibrate. The hammers 3E are functionally connected to the action units 3D, respectively, and are driven for free rotation by the actuated action units 3D. The strings are horizontally stretched over the array of the hammers 3E, and are struck with the hammers at the end of the free rotation for generating acoustic piano tones. Thus, the keyboard 3C, action units 3D, hammers 3E, dampers and strings 3F behave as similar to those of a standard grand piano, and no further description is hereinafter incorporated for the sake of simplicity.

The built-in music rack 7A is secured to the piano cabinet 2A, and is not of the type attached to and detached from the keyboard musical instrument. The built-in music rack 7A includes a back plate 7*b*, a base 20 and a slider 25. In this instance, the base 20 and slider 25 are made of metal such as, for example, aluminum alloy, and the back plate 7*b* is made of wood. However, the base 20 and slider 25 may be made of wood or synthetic resin. The back plate 7*b* is same in size as the back plate of the back board incorporated in the standard grand piano. The base 20 is embedded into the piano cabinet 2A, and laterally extends in the piano cabinet 2A. In other words, the base 20 is in parallel to the keyboard 3C. The slider 25 is connected to the base 20 in such a manner as to be laterally slidable on the base 20. The back plate 7*b* is fixed to the slider 25, and, accordingly, the back plate 7*b* laterally slides on the base 20 together with the slider 25 as indicated by arrow AR1. Thus, a pianist can adjust the back plate 7*b* to a proper position confronted with him or her by laterally moving the slider 25. The base 20 is embedded into the piano cabinet 2A, and, accordingly, does not damage the external appearance of the grand piano.

In detail, a groove 2*j* is formed in the upper beam 2*h*, and is upwardly sideward open. The groove 2*j* has a trapezoidal cross section. The metal is shaped into a trapezoidal prism, and is used as the base 20. The base 20 is as long as the groove 2*j*. The groove 2*j* is identical in shape with the base 20 so that the base 20 is snugly received in the groove 2*j*. The base 20 is secured to the upper beam 2*h*. Thus, the base 20 is embedded in the upper beam 2*h*.

The base 20 is formed with a groove 23, and the groove 23 laterally extends. The groove 23 is upwardly open, and is rearward inclined at 5–10 degrees. However, the groove 23 is shorter than the base 20, and is not open to the side board 2*f* as indicated by broken lines in FIG. 3. A small ridge 14 is formed at the front portion of the base 20, and laterally extends between the both side portions of the side board 2*f*.

An upper surface 22 extends between the small ridge 14 and the groove 23, and is inclined rearward. In this instance, a decorative panel 24 is adhered to the upper surface 22 at least in front of the groove 23. However, the upper surface 22 may extend between both side portions of the side board 2*f* without any decorative panel. The decorative panel 24 is also inclined rearward. A music score book 13 is put against the back plate 7*b*, and is made stand on the decorative panel 24. Since the decorative panel 24 is rearward inclined, the music score book 13 keeps the attitude. Even if the music score book 13 frontward slides on the decorative panel 24, the music score book 13 never exceeds the small ridge 14, and, accordingly, is never fallen onto the floor.

The slider 25 is as wide as the back plate 7*b*, and the upper portion is bifurcated. Namely, the slider 25 is broken down into a sliding plate portion 25A and a board receiving portion 25B. The sliding plate portion 25A has a constant thickness, which is slightly less than the width of the groove 23. On the other hand, the board receiving portion 25B has a front wall and a rear wall spaced from each other by a distance approximately equal to the thickness of the back plate 7*b*. A lubrication sheet 26 is adhered to the front and rear surfaces of the sliding plate portion 25A and the rear surface of the board receiving portion 25B, and is made of felt or artificial leather. Although the lubricant sheet 26 is adhered to the sliding plate portion 25A, the total thickness is approximately equal to the width of the groove 23 so that the sliding plate portion 25A is insertable into and detachable from the groove 23 as indicated by arrow AR2. The lubrication sheet 26 prevents the sliding plate portion 25A and the base 20 from metal-to-metal contact. While a pianist is moving the slider 25 in the lateral direction AR1, the lubricant sheet 26 smoothly slides on the metallic inner walls, and does not give rise to noise. Nevertheless, the sliding plate portion 25A covered with the lubrication sheet 26 is not loose so that the back plate 7*b* is never unintentionally moved on the base 20.

The board receiving portion 25B is as wide as the back plate 7*b*, and the back plate 7*b* is snugly received in the space 27 between the front wall and the rear wall. The back plate 7*b* is adhered to the board receiving portion 25B. Otherwise, the back plate 7*b* is secured to the board receiving portion 25B by means of screws.

Assuming now that a pianist prepares the grand piano for his or her performance, he or she checks the music rack 7A to see whether or not the back plate 7*b* keeps the music score book 13 at the proper position. If the pianist finds the back plate 7*b* improper, he or she sideward pushes the slider 25. The slider 25 slides along the groove 23, and the back plate 7*b* reaches the proper position. Then, the pianist stops to push sideward. The base 20 and slider 25 keep the back plate 7*b* at the proper position. The pianist puts the music score book 13 against the back plate 7*b*, and the inclined decorative panel 22 prohibits the music score book 13 from slip.

When a trainee sits side by side together with his or her music teacher or when two pianist sit in front of the keyboard 3C for a four-handed performance, the trainee or the pianist pushes the slider 25 sideward, and adjusts the back plate 7*b* to an proper position just confronted with him or her. In this situation, a wide vacant space is created on either side of the desk board. The vacant space is available for the practice. For example, the music teacher may put a metronome and/or a clock on the decorative panel 24.

Otherwise, a lot of music score books and/or text books may be stacked on the decorative panel 24.

If any music score is not required for a performance, the back plate 7*b* may be pulled out from the base 20 together with the slider 25.

As will be understood from the foregoing description, the keyboard musical instrument, i.e., the grand piano has the built-in music rack 7A with the laterally slidable back plate 7*b*. The music score book 13 is adjusted to the proper position through the lateral motion of the slidable back plate 7*b* along the groove 23. The pianist does not need to pull out the carrier 25 from and push it into the groove 23. Thus, the pianist can easily adjust the music score book 13 to the proper position.

Neither detachable panel nor guide bar is required for the keyboard musical instrument. The base 20 is embedded in the piano cabinet 2A, and only the back plate 7*b* upwardly projects from the piano cabinet 2A. The grand piano according to the present invention is identical in external appearance with the standard grand piano. Thus, the built-in music rack 2A according to the present invention does not damage the external appearance of the keyboard musical instrument.

The keyboard musical instrument with the built-in music rack has other additional advantages. The small ridge 14 forms a part of the base 20, and the inclined upper surface 22 is a part of the surface of the base 20. Neither small ridge nor inclined plate is required for the built-in music rack 7A. While the metal is being shaped into the base 20, the small ridge 14 and inclined upper surface 22 are formed concurrently with the other portion. The assembling work is simple. Thus, the manufacturer can reduce the parts of the music rack, and the production cost is decreased.

Another advantage is that the lubricant sheet 26 permits the slider 25 to laterally slide without noise. Although the lubricant sheet 26 is not indispensable element of the built-in music rack 7A, the lubricant sheet 26 is preferable to a slider directly in contact with the inner surface of the base 20.

Second Embodiment

Figure 5:
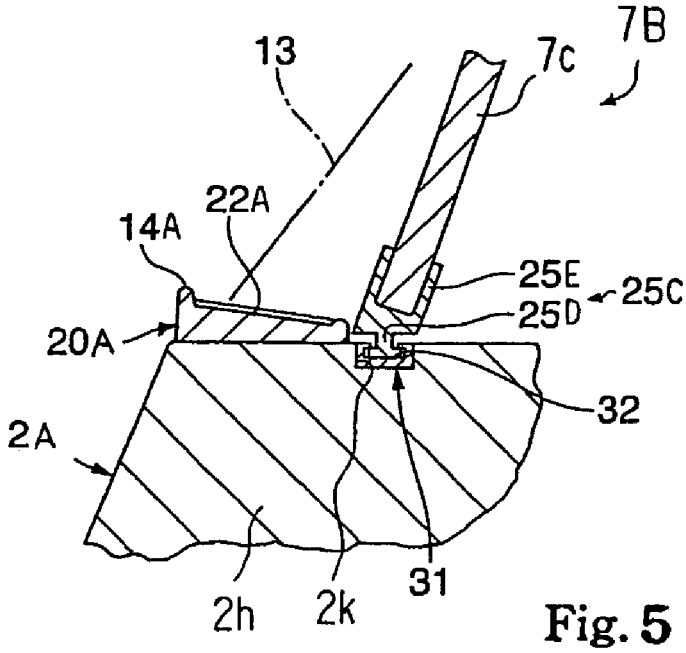
FIG. 5 is a cross sectional view showing the structure of a built-in music rack incorporated in another grand piano according to the present invention.

Turning to FIG. 5 of the drawings, another grand piano is illustrated together with a built-in music rack 7B. The grand piano implementing the second embodiment is similar to the grand piano described as the first embodiment except the built-in music rack 7B. For this reason, description is focused on the built-in music rack 7B, and other component parts are labeled with the references designating the corresponding component parts shown in FIG. 3.

The built-in music rack 7B includes a back plate 7*c*, a table 20A, a carrier 25C and a guide rail 31. In this instance, the back plate 7*c* and table 20A are made of wood, and the carrier 25C and guide rail 31 are made of metal or alloy. However, the back plate 7*c*, table 20A may be made of metal or alloy, and synthetic resin is available for these component parts 7*c*, 20A, 25C and 31. The guide rail 31 is embedded into the piano cabinet 2A, and laterally extends. In other words, the guide rail 31 is in parallel to the keyboard 3C. The carrier 25C is engaged with the guide rail 31, and is laterally movable along the guide rail 31. The back plate 7*c* is supported by the carrier 25C, and is laterally moved together with the carrier 25C. Thus, the built-in music rack 7B is moved to a proper lateral position, and does not damage the external appearance of the grand piano.

A shallow groove 2*k* is formed in the upper beam 2*h*, and laterally extends as similar to the groove 2*j*. The shallow groove 2*k* is upwardly open, and the guide rail 31 is inserted into the shallow groove 2*k*. The guide rail 31 is equal in length to the shallow groove 2*k*, and is secured to the upper beam 2*h*. Thus, the guide rail 31 is embedded in the upper beam 2*h*, and does not project from the upper beam 2*h*. The guide rail 31 is formed with a guide space 32, which is laterally elongated over the length of the guide rail 31. Thus, the guide space 32 is in parallel to the keyboard 3C. The guide space 32 has a channel-like cross section, and a pair of blocking portions inwardly projects. However, the blocking portions are spaced from each other. For this reason, the guide space 32 is open through between the blocking portions to the outside of the piano cabinet 2A. In this instance, the guide rail 31 is made of aluminum alloy, and the aluminum alloy is shaped into the guide rail 31 through an extrusion.

The carrier 25C has a lower sliding portion 25D and an upper board receiving portion 25E. In this instance, the carrier 25C is made of the aluminum alloy, and the aluminum alloy is shaped into the carrier 25C through the extrusion. The lower sliding portion 25 has a cross section like an inverted T-letter. In other words, the lower sliding portion 25 is identical in cross section with the guide space 32. The lower sliding portion 25 is inserted into the guide space 32, and upwardly projects from between the blocking portions of the guide rail 31. The blocking portions prevent the lower sliding portion from pulling out upwardly. Thus, the lower sliding portion 25D is slidably engaged with the guide rail 31. Though not shown in FIG. 5, a lubrication sheet is inserted between the guide rail 31 and the sliding portion 25D, and permits the carrier 25D to smoothly slide along the guide rail 31. A linear ball bearing may be inserted between the sliding portion 25D and the guide rail 31. A wide opening (not shown) is formed in the guide rail 31, and the guide space 32 is open to the ambience through the wide opening. The opening is wide enough to permit the sliding portion 25D to pass therethrough. When the carrier 25C is assembled with the guide rail 31, the sliding portion 25D is inserted into the guide space 32 through the wide opening.

The board receiving portion 25E is bifurcated, and the space between the front wall and the rear wall is approximately equal to the thickness of the back plate 7*c*. The bifurcated board receiving portion 25E is equal in width to the back plate 7*c*, and the back plate 7*c* is snugly received in the board receiving portion 25E. The back plate 7*c* is adhered or bolted to the board receiving portion 25E. Thus, the back plate 7*c* is laterally movable together with the carrier 25C.

The table 20A is prepared for the music rack 7B separately from the guide rail 31. The table 20A is located in front of the guide rail 31, and is secured to the upper beam 2*h*. The table 20A is longer than the guide rail 31, and laterally extends in parallel to the guide rail 31. The table 20A has an upper surface 22A, and the upper surface 22A is rearward inclined. A small ridge 14A projects along the front end line, and does not permit the music score book 13 to exceed thereover. Thus, the inclined surface 22A and small ridge 14A are advantageous as similar to the inclined surface 22 and small ridge 14.

As will be understood from the foregoing description, the music score book 13 is adjustable to the proper position through the lateral motion of the back plate 7*c* along the guide rail 31. The pianist only exerts force on the carrier 25C or back plate 7*c*. The pianist does not need to pull out the back plate 7*c* from and push it into the guide rail 31. Thus, the pianist can easily adjust the music score book 13 to the proper position.

The guide rail 31 is embedded into the piano cabinet 2A. Only a part of the board receiving portion 25E and back plate 7*c* are seen by the audience. Thus, the music rack 7B does not damage the external appearance of the grand piano.

Third Embodiment

Figure 6:
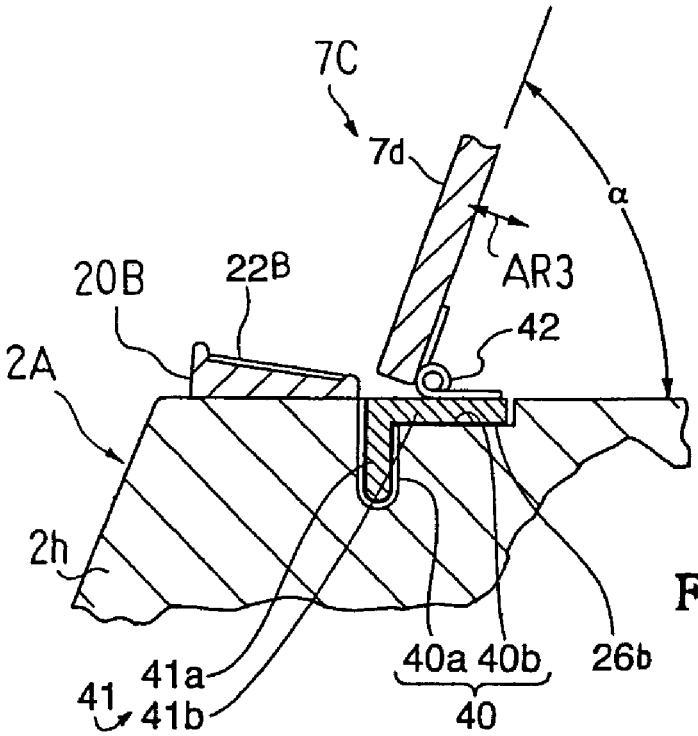
FIG. 6 is a cross sectional view showing the structure of a built-in music rack incorporated in yet another grand piano according to the present invention.

Turning to FIG. 6 of the drawings, yet another built-in music rack 7C is provided on the piano cabinet 2A of a grand piano embodying the present invention. The built-in music rack 7C also includes a back plate 7*d*, a carrier 41 and a table 20B. A guide groove 40 is formed in the piano cabinet 2A, and the carrier 41 slides in the guide groove 40. Thus, any guide rail is not required for the carrier 41. The number of the component parts is reduced, and, for this reason, the production cost is decreased.

The guide groove 40 laterally extends between both side portions of the side board 2*f*, and the carrier 41 is slidably received in the guide groove 40. The guide groove 40 is in parallel to the keyboard 3C, and permits the carrier 41 to be moved therealong. The back plate 7*d* is supported by the carrier 41, and is laterally moved together with the carrier 41. The table 20B is provided in front of the guide groove 40. Most of the carrier 41 disappears in the guide groove 40. Only the back plate 7*c* and table 20B are seen by the audience. Thus, the built-in music rack 7C is same in external appearance as those of the standard music rack.

The guide groove 40 is formed in the upper beam 2*h*, and is separated into a deep groove 41*a* and a shallow groove 41*b*. The deep groove 41*a* is contiguous to the shallow groove 41*b* so that the guide groove 40 has a cross section like that of an angle beam. The carrier 41 is broken down into a vertical portion 41*a* and a horizontal portion 41*b*. The vertical portion 41*a* downwardly projects from the front end line of the horizontal portion 41*b*. Thus, the carrier 41 has a cross section like that of the angle beam. In other words, the carrier 40 is similar in cross section to the guide groove 40.

The carrier 41 is inserted into the guide groove 40. The vertical portion 41*a* is received in the deep groove 40*a*, and the horizontal portion 40*b* is put on the inner surface of the upper beam 2*h* which defines the bottom of the shallow groove 40*b*. A lubricant sheet 26*b* is adhered to the lower surface of the horizontal portion 41*b* and the side surfaces of the vertical portion 41*a*. The lubricant sheet 26*b* is same as the lubricant sheet 26, and permits the carrier 41 to smoothly slide in the guide groove 40. Since the inner walls, which defines the deep groove 40*a*, prevent the vertical portion 41*a* from being inclined in the deep groove 40*a*, the carrier 41 is stable in the guide groove 40. Although the music score book 13 exerts the moment in the clockwise direction on the carrier 40 through the back plate 7*d*, the carrier 41 keeps the attitude in the guide groove 40.

The carrier 40 includes a torque hinge 42, and the torque hinge 42 is provided between the upper surface of the horizontal portion 41*b* and the rear surface of the back plate 7*d*. When moment is exerted on the torque hinge 42, the torque hinge 42 varies the angle á between the back plate 7*d* and the upper beam 2*h*. In this instance, the angle á is varied from zero to 80 degrees. When a pianist leaves the grand piano, the back plate 7*d* may be folded back onto the upper beam 2*h*. The critical moment, at which the torque hinge 42 starts to change the angle á, is greater than the moment generated by the self-weight of the back plate 7*d*. For this reason, while any moment is not being exerted on the torque hinge 42, the torque hinge 42 does not change the angle á, and keeps the back plate 7*d* stable. Thus, the built-in music rack 7C permits a pianist to change the angle á as well as the lateral position.

The table 20B is provided in front of the guide groove 41, and is formed with the small ridge and inclined upper surface 22B. The table 20B is similar to the table 20A, and no further description is hereinafter incorporated for the sake of simplicity.

As will be understood from the foregoing description, the built-in music rack 7C, which is incorporated in the keyboard musical instrument, i.e., grand piano, permits the pianist to adjust a document such as a sheet of music score to a proper position just confronted with the player through the lateral motion of the back plate 7*d* along the guide groove 40. The pianist does not need to pull out the carrier 41 from and insert it into the guide groove 40. The pianist is expected to exert the force on the back plate 7*d*. Thus, the built-in music rack 7C permits the pianist to easily adjust the document to the proper position.

Most of the carrier 41 is hidden in the piano cabinet 2A, and the external appearance is same as that of the standard grand piano.

The back plate 7*d* is tilted by virtue of the torque hinge 42 so that the document is directed to the eyes of the pianist through the tilt motion of the back plate 7*d*.

The grand piano implementing the third embodiment has another additional advantage in that the number of the component parts is reduced by virtue of the guide groove 40 directly formed in the piano cabinet 2A.

Fourth Embodiment

Figure 7:
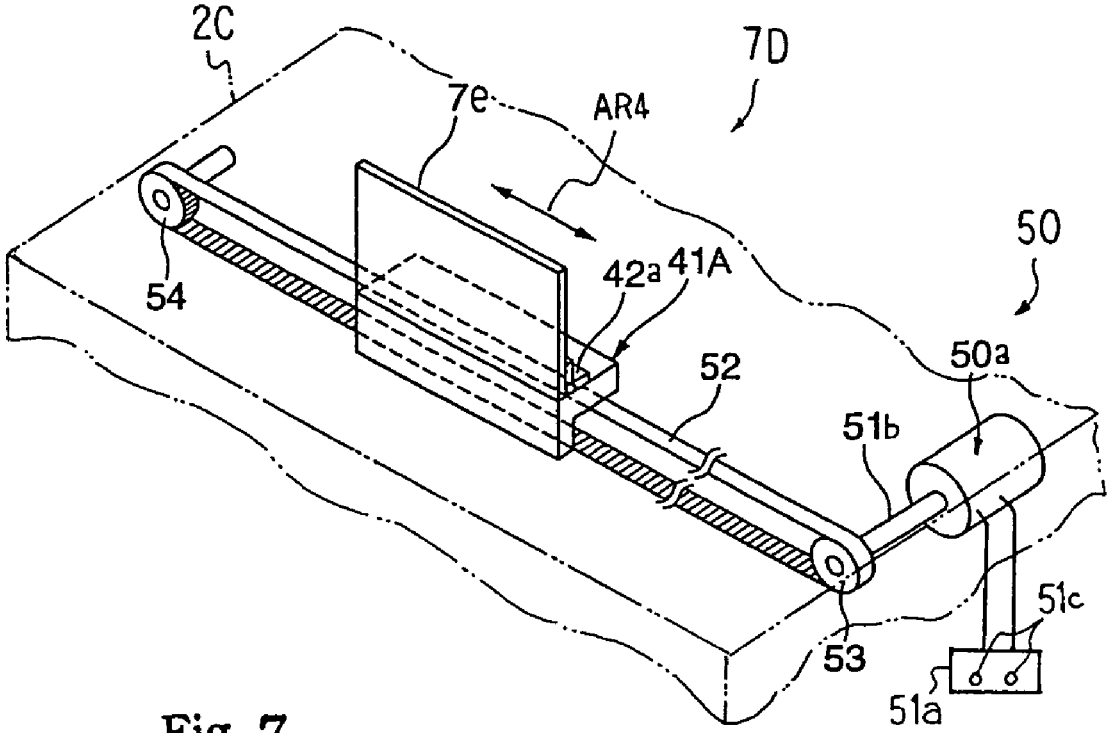
FIG. 7 is a perspective view showing the structure of a built-in music rack incorporated in a keyboard musical instrument according to the present invention.

Turning to FIG. 7 of the drawings, a built-in music rack 7D is incorporated in a keyboard musical instrument embodying the present invention. An acoustic piano, an organ or an electronic keyboard serves as the keyboard musical instrument. The musical instrument includes a cabinet 2C, a keyboard (not shown) and a tone generating system (not shown). In case where the acoustic piano serves as the keyboard musical instrument, the action units, hammers and strings as a whole constitute the tone generating system. On the other hand, if the electronic keyboard is the keyboard musical instrument, an electronic sound generating system and a sound system, which includes amplifiers and loud speakers, are incorporated in the tone generating system.

The built-in music rack 7D includes a back plate 7*e*, a carrier 41A and a motor-operated driving system 50. A part of the upper surface of the cabinet 2C is inclined rearward, and any table is not provided on the upper surface of the cabinet 2C. Since most of the carrier 41A and motor-operated driving system 50 are hidden in the cabinet 2C, the external appearance is same as that of the acoustic piano or electronic keyboard. The back plate 7*e* is connected to the carrier 41A by means of a torque hinge 42*a*, and the projects over the cabinet 2C. The torque hinge 42*a* is same as the torque hinge 42, and no further description is hereinafter incorporated for the sake of simplicity. The motor-operated driving system 50 is connected to the carrier 41A. The motor-operated driving system 50 exerts force on the carrier 41A, and makes the back plate 7*e* laterally moved.

The motor-operated driving system 50 includes an electric motor 50*a*, a switch box 51*a*, an endless belt 52*a* and a pair of pulleys 53/54. The electric motor 50*a* is provided inside the cabinet 2C, and is located near a side wall of the cabinet 2C. The output shaft 51*b* frontward projects, and the pulley 53 is fixed to the output shaft 51*b*. The other pulley 54 is provided on the other side, and is rotatably supported by a bracket (not shown). The endless belt 52 is stretched between the pulleys 53 and 54 in parallel to the keyboard 3C, and the carrier 41A is fixed to the endless belt 52. Though not shown in FIG. 7, tooth are formed on the pulleys 53/54, and the endless belt 52 is formed with tooth on the inner surface. For this reason, the torque is exactly transmitted from the pulley 53 to the endless belt 52 without serious slip.

The switch box 51*a* is secured to the cabinet 2C, and is located near the player. A pair of push buttons 51*c* is provided on the switch box 51*a*. When a user pushes one of the push buttons 51*c*, the electric motor 50*a* drives the pulley 53 for rotation, and the carrier 41A is laterally moved toward the left side together with the back plate 7*e*. When the back plate 7*e* reaches a proper position, the user removes his or her finger from the push button 51*c*, and the electric motor 50*a* stops the rotation. When the user pushes the other button 51*c*, the electric motor 50*a* drives the output shaft 51*b* for rotation in the opposite direction, and, accordingly, the carrier 41A is moved toward the right side together with the back plate 7*e*. Upon arrival of the back plate 7*e* at the proper position, the user removes his or her finger from the push button 51*c* so that the back plate 7*e* stops at the proper position.

As will be understood from the foregoing description, a music score book is adjustable to the proper position through the lateral motion of the back plate 7*e* along the endless belt 52, and the motor-operated driving system 50 does not damage the external appearance of the keyboard musical instrument.

Fifth Embodiment

Figure 8:
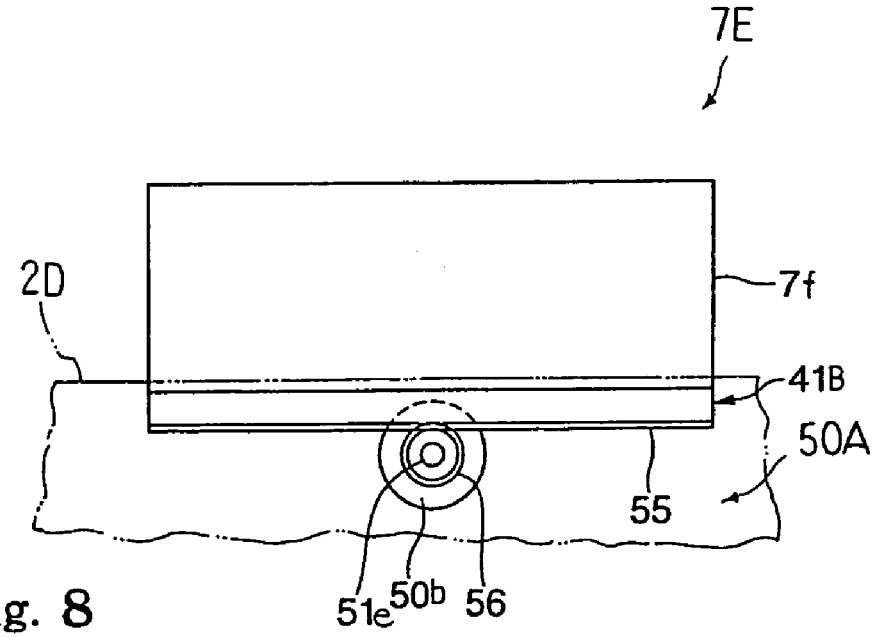
FIG. 8 is a front view showing the structure of a built-in music rack incorporated in another keyboard musical instrument according to the present invention.

Turning to FIG. 8 of the drawings, another built-in music rack 7E is incorporated in a keyboard musical instrument embodying the present invention. The keyboard musical instrument is either acoustic piano or electronic keyboard, and has a cabinet 2D. The built-in music rack 7E is adjustable to a proper position confronted to a player, and most of the built-in music rack 7E is hidden in the cabinet 2D. For this reason, the external appearance is same as that of the corresponding standard keyboard musical instrument.

The built-in music rack 7E includes a back plate 7*f*, a table (not shown), a carrier 41B and a motor-operated driving mechanism 50A. The motor-operated driving mechanism 50A is installed inside the cabinet 2D, and is hidden therein. The back plate 7*f* is connected to the motor-operated driving mechanism 50A by means of the carrier 41B, and is bi-directionally moved in the lateral direction, i.e., in parallel to the keyboard 3C. Only the back plate 7*f* projects from the cabinet 2D, and the external appearance is same as that of the corresponding standard keyboard musical instrument. Although the table (not shown) is provided on the cabinet 2D in front of the motor-operated driving mechanism 50A, the table is not shown in FIG. 8.

The motor-operated driving mechanism 50A includes an electric motor 50*b*, a switch box (not shown) and a combination of a pinion 56 and rack 55. The electric motor 50*b* is located around the center of the cabinet 2D, and the output shaft 41*e* forwardly projects. The pinion 56 is fixed to the output shaft 41*e*. On the other hand, the rack 55 is fixed to the lower surface of the carrier 41B, and laterally extends. The pinion 56 is held in meshing engagement with the rack 55.

In this instance, the rack 55 is secured to the carrier 41B, the electric motor 50*b*. However, the pinion 56 may be provided on the carrier 41B in such a manner as to be hold in meshing engagement with the rack 55 supported by the cabinet 2D. This feature is desirable from the viewpoint of the stroke. A long rack, which is equal in length to the width of the cabinet 2D, permits the back plate 7*f* to travel between the left side to the right side. Thus, the stroke is increased.

When a user pushes one of the push buttons on the switch box (not shown), the electric motor 50*b* drives the pinion 56 for rotation, and the rack 55 is laterally moved toward the left side together with the carrier 41B and back plate 7*f*. When the back plate 7*f* reaches a proper position, the user removes his or her finger from the push button, and the electric motor 50*b* stops the rotation.

If the user wishes to move the back plate 7*f* in the opposite direction, the user pushes the other button, and the electric motor 50*b* drives the pinion 56 for rotation in the opposite direction. As a result, the rack 55 is moved toward the right side together with the carrier 41B and back plate 7*f*. Upon arrival of the back plate 7*f* at the proper position, the user removes his or her finger from the push button so that the back plate 7*f* stops at the proper position.

As will be appreciated from the foregoing description, the built-in music rack 7E permits the player to adjust a music score book to the proper position through the lateral motion of the back board 7*f* along the rack 55, and the motor-operated driving mechanism 50A, which is hidden inside the cabinet 2D, does not make the user feel the keyboard musical instrument strange.

Although particular embodiments of the present invention have been shown and described, it will be apparent to those skilled in the art that various changes and modifications may be made without departing from the spirit and scope of the present invention.

The upper beam 2*h* does not set any limit to the technical scope of the present invention. The base 20 or guide rail 31 may be directly supported by the side board if inside the piano cabinet 2A. Otherwise, the base 20 or guide rail 31 may be embedded in another component part of the piano cabinet such as, for example, a desk rail or rails, an upper front board and a top board.

The back plate 7*b*/7*c*/7*d*/7*e*/7*f* may have an inclined surface portion. In other words, the back plate 7*b*/7*c*/7*d*/7*e*/7*f* is integral with the inclined surface portion. In this instance, the back plate has an L-letter cross section, and a music score book is put against the back plate portion, and the inclined surface portion supports the foot of the music score book.

The motor-operated driving mechanism 50/50A may be directly connected to the back plate 7*b*/7*c*/7*d*/7*e*/7*f*. In other words, the carrier is omitted from between the back plate and the driving mechanism.

The single back plate 7*b* does not set any limit to the technical scope of the present invention. A pair of sliders and back plates 7*b* may be inserted into the groove 23 for the four-handed performance.

The lubricant sheet 26 may be adhered to the inner surface defining the groove 23.

A guide rail may be not formed with any recess. In this instance, a carrier is formed with a recess downwardly open, and the guide rail is received in the recess.

A one-way clutch or a free-lock hinge may be provided between the upper beam 2*h* and the back plate 7*d*. Friction discs or another sort of tilt mechanism is also available for the music rack. Otherwise, a prop may be connected to the rear surface of the back plate 7*d*. In this instance, the prop keeps the back plate 7*d* at the given angular position.

The built-in music rack may form a part of a mute piano or an automatic player piano. The mute piano is built up on the basis of the grand piano or upright piano, and a hammer stopper and an electronic sound generating system are installed in the piano case. The hammer stopper is changed between a free position and a blocking position. While a pianist is playing a piece of music through acoustic piano tones, the mute piano keeps the hammer stopper outside of the trajectories of the hammers so that the hammers selectively strikes the strings for generating the acoustic piano tones. When the pianist wishes to play the piece of music through electronic tones, the hammer stopper is moved into the trajectories of the hammers, i.e., the blocking position. While the pianist is fingering the piece of music on the keyboard, the hammers are driven for rotation, and rebound on the hammer stopper before reaching the strings. Any string is not struck with the hammers, and, accordingly does not vibrate. Nevertheless, the electronic sound generating system monitors the key motion, and electronically produces the electronic tones corresponding to the acoustic piano tones to be generated. Thus, the pianist can play the piece of music on the mute piano through the acoustic piano tones or electronic tones.

The automatic player piano is also built up on the basis of the grand piano or upright piano. An automatic playing system is installed in the piano case. A controller and solenoid-operated key actuators form essential parts of the automatic playing system. The controller analyzes music data codes, which have been already supplied from a suitable information storage medium, and determines the keys to be depressed and timing at which the keys start to sink through the data analysis. When the time comes, the controller selectively supplies driving signals to the solenoid-operated key actuators at appropriate timing, and the solenoid-operated key actuators move the associated keys without any fingering on the keyboard so that the hammers are driven for rotation through the action units. The hammers strike the strings for generating the acoustic piano tones. Thus, the automatic player piano can perform a piece of music without any fingering of a human player. Several automatic player pianos further include recording systems. In this instance, the music data codes are produced in an original performance by the recording system.

The music rack 7A, 7B, 7C and 7D may be installed in upright pianos. A narrow slot, which laterally extends, is formed in the front board, and the guide mechanism, which is installed inside the piano cabinet, is connected through the slot to the back plate. The narrow slot is not conspicuous so that the external appearance is almost same as that of a standard upright piano.

The motor 50*a*/50*b* may be replaced with another sort of power source such as, for example, a solenoid-operated actuator, a combination of a foot pedal and a link system or a combination of a handle and a link system.

The pulleys 53/54 and endless belt 52 do not set any limit to the technical scope of the present invention. A wire or chains may be connected between the electric motor 50*a* and the carrier 41A.

Claim languages are correlated with the components of the grand pianos/keyboard musical instruments described hereinbefore as follows. An element "cabinet" is corresponding to the piano cabinet 2A and the cabinets 2C and 2D. The action units 3D, hammers 3E and strings 3F as a whole constitute an element "tone generating system", and the electronic sound generating system and sound system serve as the "tone generating system" in the electronic keyboard. Another element "desk board" is corresponding to the combination of the back plate 7*b*/7*c*/7*d*/7*e*/7*f* and inclined surface portion 22 or table 20A/20B. In case where the back plate is integral with the inclined surface portion, the back plate and inclined surface portion as a whole constitute the "desk board". The combination of the base 20 and the slider 25, the combination of the guide rail 31 and the carrier 25C, the combination of the inner surfaces defining the guide groove 40 and the carrier 41, the combination of the motor-operated driving system 50 and the carrier 41A and the combination of the motor-operated driving mechanism 50A and the carrier 41B are corresponding to yet another element "guide".

The torque hinge 42/42*a* is an example of still another element "tilt mechanism". The one-way clutch, free-lock hinge, prop and friction discs also serve as the "tilt mechanism".

What is claimed is:

1. A keyboard musical instrument for generating tones, comprising:

a cabinet defining an inner space, and having a surface;

a keyboard having plural keys selectively depressed for designating pitches of said tones to be generated, and placed on said surface so as to expose said plural keys to the outside of said cabinet;

a tone generating system at least partially housed in said cabinet, and connected to said keyboard for generating tones at said pitches; and a music rack including a desk board against which a document is put and a guide having a base embedded in a component member of said cabinet in a direction parallel to said keyboard and a slider partially inserted into said groove and connected to a part of said desk so as to permit a user to move said desk board along said groove through a sliding motion of said slider, thereby being hidden inside said cabinet and connected to said desk board, said base having an upper surface rearward inclined and forming another part of said desk board.

2. The keyboard musical instrument as set forth in claim 1, in which guide is partially embedded in a component member of said cabinet.

3. The keyboard musical instrument as set forth in claim 2, in which said guide includes a base embedded in said component member and formed with a groove extending in said direction, and a slider partially inserted into said groove and connected to a part of said desk board so as to permit said desk board to change a position along said groove through a sliding motion of said slider.

4. The keyboard musical instrument as set forth in claim 3, in which said base has an upper surface rearward inclined and forming another part of said desk board.

5. The keyboard musical instrument as set forth in claim 1, in which said base is formed with a ridge extending along a front end of said base in parallel to said keyboard and forming yet another part of said desk board, and said upper surface extends between said ridge and said groove.

6. A keyboard musical instrument for generating tones, comprising:

a cabinet defining an inner space, and having a surface;

a keyboard having plural keys selectively depressed for designating pitches of said tones to be generated, and placed on said surface so as to expose said plural keys to the outside of said cabinet;

a tone generating system at least partially housed in said cabinet and connected to said keyboard for generating tones at said pitches; and a music rack including a desk board against which a document is put and a guide having a base embedded in a component member of said cabinet in a direction parallel to said keyboard and a slider partially inserted into said groove and connected to a part of said desk so as to permit a user to move said desk board along said groove through a sliding motion of said slider, thereby being hidden inside said cabinet and connected to said desk board, said guide further including a lubrication sheet between said slider and an inner surface of said base defining said groove so that said slider smoothly slides along said groove.

7. A keyboard musical instrument for generating tones, comprising:

a cabinet defining an inner space, and having a surface;

a keyboard having plural keys selectively depressed for designating pitches of said tones to be generated, and placed on said surface so as to expose said plural keys to the outside of said cabinet;

a tone generating system at least partially housed in said cabinet, and connected to said keyboard for generating tones at said pitches; and a music rack including a desk board against which a document is put and a guide partially embedded in a component member of said cabinet so as to be hidden inside said cabinet and connected to said desk board so as to permit a user to move said desk board in a direction parallel to said keyboard, wherein said guide includes a guide rail embedded in said component member and formed with a recess extending in parallel to said keyboard, and a carrier having a projection inserted into said recess so as to be movable in said direction and connected to a part of said desk board so as to permit said desk board to change a position alone said recess through a lateral motion of said carrier, and wherein said desk board further has a table provided on said component member in front of said guide rail, and said table has an upper surface inclined rearward.

8. The keyboard musical instrument as set forth in claim 7, in which said table is formed with a ridge along a front end thereof, and said upper surface extends between said ridge and said a rear end of said table.

9. A keyboard musical instrument for generating tones, comprising:

a cabinet defining an inner space, and having a surface;

a keyboard having plural keys selectively depressed for designating pitches of said tones to be generated, and placed on said surface so as to expose said plural keys to the outside of said cabinet;

a tone generating system at least partially housed in said cabinet, and connected to said keyboard for generating tones at said pitches;

a music rack including a desk board against which a document is put and a guide partially embedded in a component member of said cabinet so as to be hidden inside said cabinet and connected to said desk board so as to permit a user to move said desk board in a direction parallel to said keyboard; and a tilt mechanism provided between said guide and said desk board so that said document is inclined through said tilt mechanism, wherein said guide includes an inner surface of said component member defining a guide groove along said keyboard in parallel thereto, and a carrier put in said guide groove in such a manner as to slide along said guide groove, and connected to a part of said desk board through said tilt mechanism.

10. The keyboard musical instrument as set forth in claim 9, in which said guide groove includes a shallow groove extending along said keyboard and a deep groove extending along said keyboard and contiguous to said shallow groove so that said guide groove has an inverted L-letter cross section, and in which said carrier includes a thin portion put on a part of said inner surface defining a bottom of said shallow groove in a slidable manner and a thick portion downward projecting from a front end of said thin portion and received in said deep groove so as to prevent said thin portion from being inclined.

11. The keyboard musical instrument as set forth in claim 9, in which said guide further includes a lubrication sheet provided between said carrier and said inner surface so as to render the sliding smooth.

12. A keyboard musical instrument for generating tones, comprising:

a cabinet defining an inner space, and having a surface;

a keyboard having plural keys selectively depressed for designating pitches of said tones to be generated, and placed on said surface so as to expose said plural keys to the outside of said cabinet;

a tone generating system at least partially housed in said cabinet, and connected to said keyboard for generating tones at said pitches; and a music rack including a desk board against which a document is put and a guide partially embedded in a component member of said cabinet so as to be hidden inside said cabinet and connected to said desk board so as to permit a user to move said desk board in a direction parallel to said keyboard, wherein said guide includes a driving mechanism having a portion moved in parallel to said keyboard and connected to said desk board so that said driving mechanism moves said desk board in parallel to said keyboard, and wherein said driving mechanism includes a motor having an output shaft selectively rotated in a clockwise direction and a counter clockwise direction, a pulley driven for rotation by said output shaft, another pulley spaced from said pulley in a direction parallel to said keyboard and rotatably supported, a loop member stretched between said pulley and said another pulley, and a carrier secured between said loop member and said desk board.

13. A keyboard musical instrument for generating tones, comprising:

a cabinet defining an inner space, and having a surface;

a keyboard having plural keys selectively depressed for designating pitches of said tones to be generated, and placed on said surface so as to expose said plural keys to the outside of said cabinet;

a tone generating system at least partially housed in said cabinet, and connected to said keyboard for generating tones at said pitches; and a music rack including a desk board against which a document is put and a guide partially embedded in a component member of said cabinet so as to be hidden inside said cabinet and connected to said desk board so as to permit a user to move said desk board in a direction parallel to said keyboard, wherein said guide includes a driving mechanism having a portion moved in parallel to said keyboard and connected to said desk board so that said driving mechanism moves said desk board in parallel to said keyboard, and wherein said driving mechanism includes a motor having an output shaft selectively rotated in a clockwise direction and a counter clockwise direction, a pinion fixed to said output shaft and a rack extending in a direction parallel to said keyboard, in which said motor and said rack are selectively connected to said carrier and said cabinet.

* * * * *